United States Patent [19]

Kvartin et al.

[11] Patent Number: 4,582,174

[45] Date of Patent: Apr. 15, 1986

[54] ELEVATOR SYSTEM

[75] Inventors: Igor Kvartin, Pequannock; Pantelis G. Tinios, Mt. Arlington, both of N.J.

[73] Assignee: Westinghouse Electric Corp., Pittsburgh, Pa.

[21] Appl. No.: 649,460

[22] Filed: Sep. 11, 1984

[51] Int. Cl.[4] ..... B66B 1/30

[52] U.S. Cl. ..... 187/29 R; 318/257

[58] Field of Search ..... 187/29; 318/257, 345 R, 318/345 G

[56] References Cited

U.S. PATENT DOCUMENTS

| | | | |
|---|---|---|---|
| 3,713,011 | 1/1973 | Johnson et al. | 321/27 R |
| 4,155,427 | 5/1979 | Caputo et al. | 187/29 R |
| 4,277,825 | 7/1981 | Johnson | 363/87 |
| 4,286,222 | 8/1981 | Caputo | 328/155 |
| 4,286,315 | 8/1981 | Johnson | 363/87 |
| 4,307,793 | 12/1981 | Caputo | 187/29 R |
| 4,416,352 | 11/1983 | Husson et al. | 187/29 R |

*Primary Examiner*—William M. Shoop, Jr.
*Assistant Examiner*—W. E. Duncanson, Jr.
*Attorney, Agent, or Firm*—D. R. Lackey

[57] ABSTRACT

A traction elevator system having an elevator car driven by a dual converter bank, solid state motor drive. The solid state motor drive includes bank selection circuits, which select the operative converter bank at any instant, and firing circuits for providing firing pulses for the selected converter bank. The energization and deenergization of the bank selection circuits and firing circuits are controlled such that the bank selection circuits are energized before the firing circuits, and, upon loss of power, the bank selection circuits are deenergized after the firing circuits.

3 Claims, 3 Drawing Figures

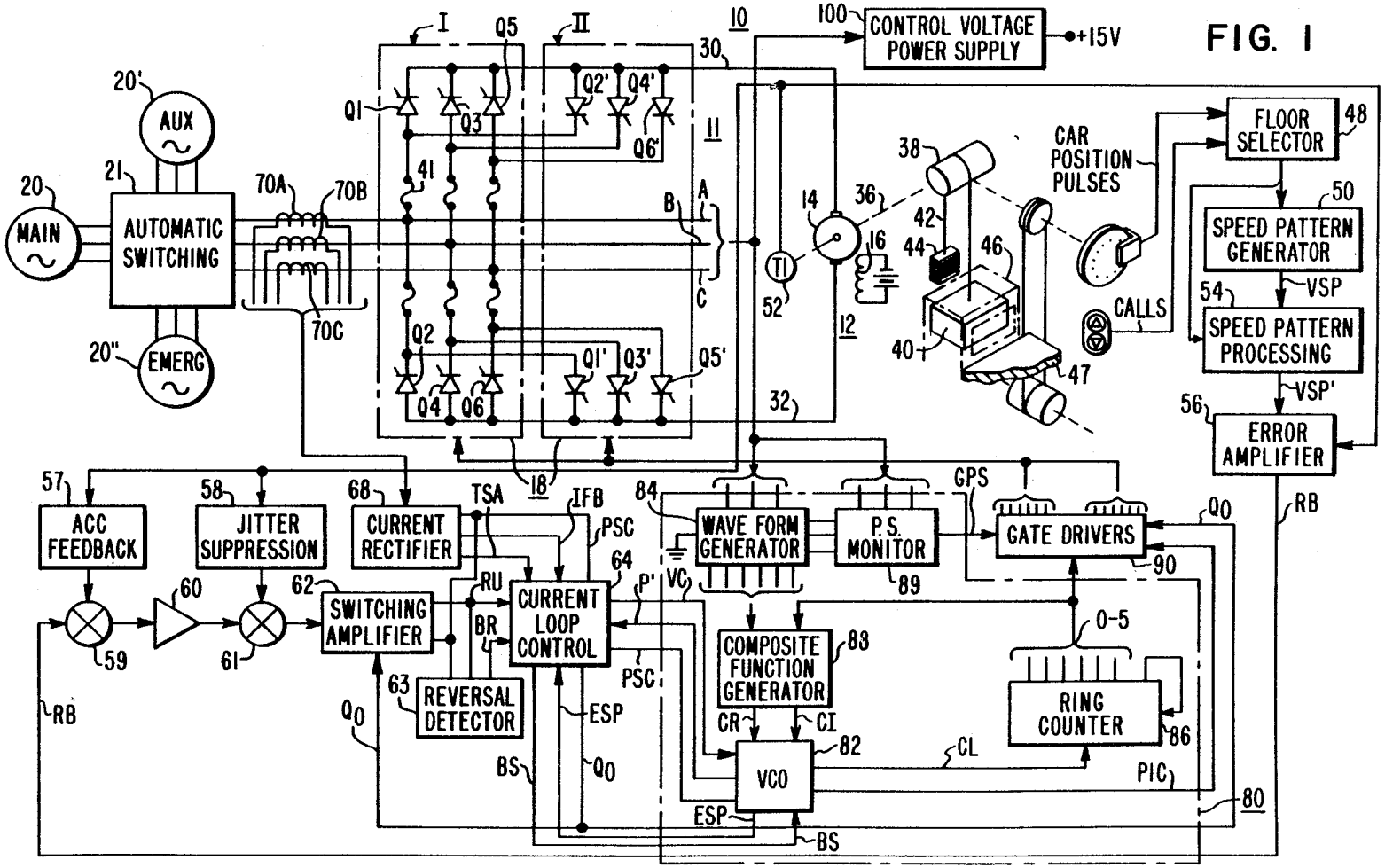
FIG. 1
FLOOR SELECTOR
SPEED PATTERN GENERATOR
SPEED PATTERN PROCESSING
ERROR AMPLIFIER
CONTROL VOLTAGE POWER SUPPLY
+15V
CAR POSITION PULSES
CALLS
GATE DRIVERS
RING COUNTER
P.S. MONITOR
WAVE FORM GENERATOR
COMPOSITE FUNCTION GENERATOR
VCO
CURRENT LOOP CONTROL
REVERSAL DETECTOR
CURRENT RECTIFIER
SWITCHING AMPLIFIER
JITTER SUPPRESSION
ACC FEEDBACK
AUTOMATIC SWITCHING
AUX
MAIN
EMERG

ELEVATOR SYSTEM

BACKGROUND OF THE INVENTION

1. Field of the Invention

The invention relates in general to elevator systems, and more specifically to traction elevator systems of the type having a dual-bridge converter, solid state DC motor drive.

2. Description of the Prior Art

The dual-bridge solid state converter constructed of thyristors has become an attractive alternative to the motor-generator set in supplying direct current for the DC drive motor of a traction elevator system. This solid state motor drive (SSMD) requires very little maintenance, since there are no moving parts, brushes, bearings, etc., and it is energy efficient, returning electrical energy to the AC supply lines during braking, and requiring no power when the elevator car is idle. The motor-generator set, however, does have an advantage when short power disturbances and interruptions occur while an elevator car is running. The inertia of the motor-generator set enables it to simply ride over short power interruptions and disturbances in a three-phase power source. With a SSMD, on the other hand, a short power interruption or voltage waveform disturbance may cause the firing circuits which gate the thyristors to gate the wrong thyristor of a bank, or to gate a thyristor of one bank while current is still flowing in the other bank. Incorrect firing of a thyristor can cause a line-to-line short circuit which blows the fast acting power fuses which protect the thyristors.

Monitoring and protective circuits have been developed to detect those power supply conditions which may result in fuse blowing, with the protective circuit automatically taking a predetermined corrective action to prevent fuse blowing. U.S. Pat. Nos. 4,155,427; 4,286,222 and 4,307,793, which are assigned to the same assignee as the present application, are directed to different aspects of power supply monitoring for elevator systems which utilize SSMD.

While the monitoring and protective circuits of the above-mentioned patents operate satisfactorily, fuse blowing has still occurred sporadically over the years for reasons which have not been entirely understood. For example, fuse blowing has occurred in the drive of a moving elevator car when the electrical power is switched from a main feeder to an auxiliary feeder, and also when the electrical power is switched from a main feeder to an emergency feeder, with fuse blowing occurring regardless of the switching speed. Fuse blowing in the SSMD of a moving elevator car has also occurred when storms have blown ice covered transmission phase conductors together, suddenly and momentarily dropping transmission voltages from the normal level to a lower voltage level.

SUMMARY OF THE INVENTION

Briefly, the present invention recognizes that certain fuse blowing situations, initiated by sudden loss or momentary drop of the AC line voltage feeding a SSMD controlling a moving elevator car, may be eliminated by proper control of the relative times that electrical control power is applied, removed, and reapplied, to certain functions of the SSMD. These functions are those: (a) which select the converter bank which should be operative at any instant, and (b) which enable the firing circuits to output firing pulses.

According to the invention, control power to the circuits of function (a) is applied before control power is applied to the circuits of function (b), when AC feeder power is applied, or reapplied, to the SSMD. Also, control power is removed from the circuits of function (b) before it is removed from the circuits of function (a), in response to a loss or drop of feeder power. When these changes were made and tested it was found that the perplexing fuse blowing problems which have plagued certain SSMD elevator installations for many years had been eliminated.

BRIEF DESCRIPTION OF THE DRAWINGS

The invention may be better understood, and further advantages and uses thereof more readily apparent, when considered in view of the following detailed description of the exemplary embodiments, taken with the accompanying drawings in which:

FIG. 1 is a schematic diagram of a traction elevator system of the type which may utilize the teachings of the invention;

DESCRIPTION OF THE PREFERRED EMBODIMENT

Figure 2:
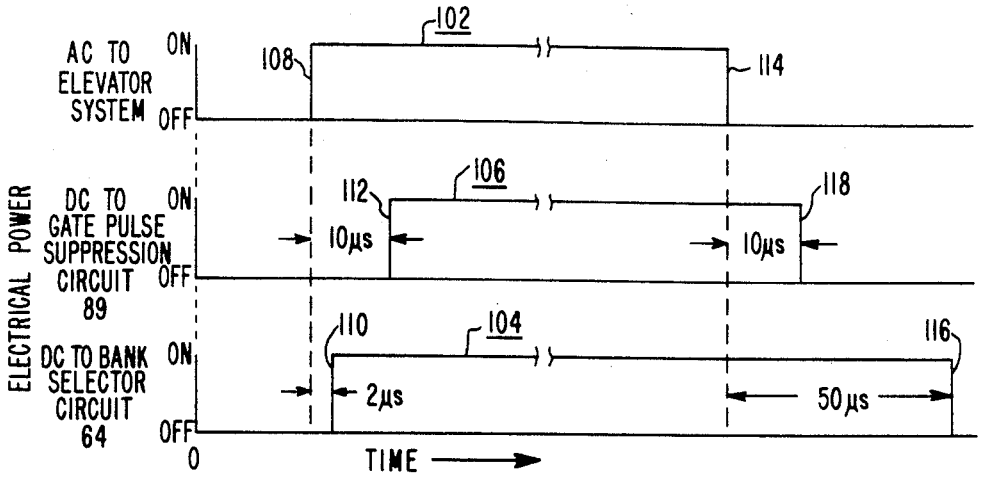
FIG. 2 illustrates timing diagrams which illustrate the relative times that control power is applied to and remove from certain drive motor functions, according to the teachings of the invention, when feeder power is applied, removed, or temporarily disturbed.

Referring now to the drawings, and to FIG. 1 in particular, there is shown an elevator system 10 which may utilize the teachings of the invention. FIG. 1 is similar to FIG. 1 of U.S. Pat. No. 4,416,352, which is assigned to the same assignee as the present application. U.S. Pat. No. 4,416,352 is hereby incorporated into the present application by reference, and only those parts of FIG. 1 which are important to the present invention will be described in detail.

Elevator system 10 is of the traction type, having a direct current drive motor 12 which includes an armature 14 and a field winding 16. Armature 14 is electrically connected to an adjustable source of direct current potential, which is in the form of solid state motor drive (SSMD) 11 having a dual converter 18. Dual converter 18 includes first and second converter banks I and II, which may be three-phase, full-wave bridge rectifiers connected in parallel opposition. Each converter bank includes a plurality of static, controlled rectifier devices or thyristors connected to interchange electrical energy between alternating and direct current circuits. Bank I includes devices Q1 through Q6 and bank II includes devices QI' through Q6'. Fuses 41 are connected to protect the solid state switching devices.

The alternating current circuit includes a main feeder or power source 20 of alternating potential and line conductors A, B and C. An auxiliary feeder 20' and/or an emergency feeder 20'' may also be used, along with automatic switching means 21.

The DC drive motor 12 includes a drive shaft, indicated generally by broken line 36, to which a traction or drive sheave 38 is attached. An elevator car 40 is supported by wire ropes 42 which are reeved over the traction sheave 38. The other ends of the ropes are connected to a counterweight 44. The elevator car 40 is disposed in a hatch or hoistway 46 of a building having a plurality of floors, such as floor 47, which floors are served by the elevator car 40.

Converter bank selection is responsive to the logic level of a signal $Q_0$ and the logic level of this signal is used to select a transfer function +1, or −1, for a switching amplifier 62. A bank selector circuit which provides signal $Q_0$ is shown as being part of current loop control function 64 in FIG. 1, with U.S. Pat. No. 3,713,011 showing suitable bank selector circuits which may be used. U.S. Pat. No. 3,713,011 is hereby incorporated into the present application by reference.

A phase controller 80 includes a voltage controlled oscillator or VC082, a waveform generator 84, a ring counter 86, a composite function generator 88, and a power supply monitor 89. The output of the phase controller 80 is applied to gate drivers 90, which in turn provide the firing pulses FPI or FPII, depending upon which bank is operational. Gate drivers 90 may be constructed as disclosed in the hereinbefore mentioned U.S. Pat. No. 3,713,011, or in U.S. Pat. No. 4,286,315, which is also assigned to the same assignee as the present application. U.S. Pat. No. 4,277,825 discloses circuitry which may be used for the VC082, ring counter 86, and the composite function generator 88. U.S. Pat. No. 4,286,222 discloses circuitry which may be used for the waveform generator 84 and the power supply monitor 89. These patents, which are assigned to the same assignee as the present application, are also hereby incorporated into the present application by reference.

The power supply monitor 89 shown in incorporated U.S. Pat. No. 4,286,222 develops a signal GPS which is used to inhibit the gate drivers 90 when abnormalities in the power supply are detected. Signal GPS is a logic 1 when the power supply is normal, and a logic 0 when it is not normal and the gate drivers should be inhibited. Incorporated U.S. Pat. No. 4,286,315 illustrates in detail the use of signal GPS.

A power supply for providing DC control power for the various functions of the elevator system 10 from the AC supplied by conductors ABC is shown generally at 100.

FIG. 2 illustrates the teachings of the invention by timing diagrams 102, 104 and 106. When AC feeder power is initially applied, or reapplied, after a momentary loss or drop, to the SSMD 11 of the elevator system 10, indicated by vertical line 108 of timing diagram 102, control power is applied to the bank selector circuit 64 which provides signal $Q_0$.as quickly as possible. This is indicated by vertical line 110 of timing diagram 104. The application of control power to the gate pulse suppression circuits 89 which provide signal GPS is deliberately delayed so signal GPS remains lwo and thus in its inhibit mode, regardless of the logic level that the circuits 89 would otherwise choose for signal GPS, with the delay being selected to allow ample time for the bank selector circuit 64 to select and output the correct logic level for signal $Q_0$. Thus, the application of control voltage from supply 100 to circuits 89, indicated by vertical line 112 of timing diagram 106, is delayed to occur later in time than the application of control power to the bank selector circuit 64. This assures that no gate firing pulses are produced until the proper converter bank is selected for operation.

When the AC feeder to the SSMD 11 is interrupted, indicated by vertical line 114 of timing diagram 102, the removal of control power from the bank selector circuit 64 is deliberately delayed such that it is removed after the removal of control power from the gate pulse suppression circuits 89. The removal of control power from the bank selector circuit 64 is indicated by vertical line 116 of timing diagram 104, and the removal of control power from the gate pulse suppression circuits 89 is indicated by vertical line 118 of timing diagram 106. Thus, regardless of the level chosen for GPS by the circuits 89, GPS will be a logic 0 and in its inhibit mode before bank selection logic is lost. This will override momentary interruptions and/or drops in AC feeder voltage, as well as properly accommodating power outages. The delay times shown in FIG. 2 relative to vertical lines 108 and 114 are typical of values found to be satisfactory, but other time values may be used.

Figure 3:
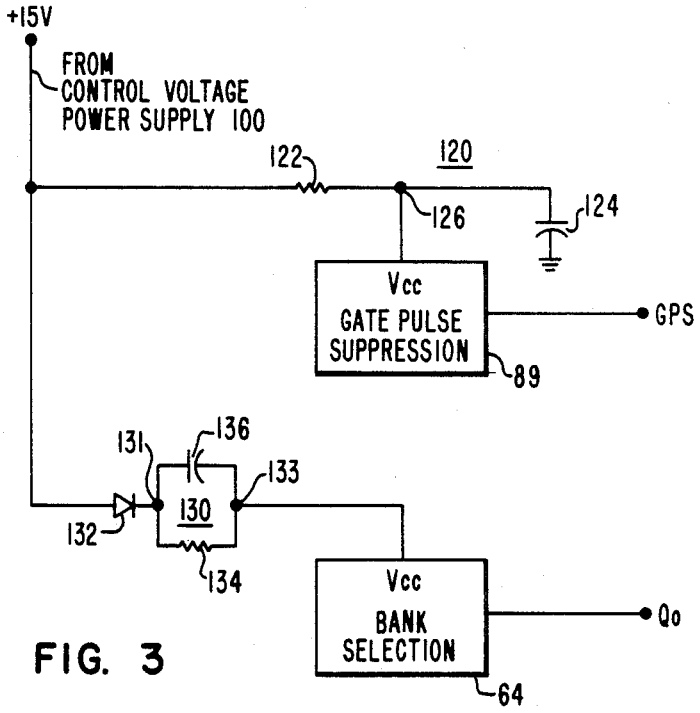
FIG. 3 is a circuit which illustrates how certain functions shown in FIG. 1 may be modified according to the teachings of the invention.

FIG. 3 is a schematic diagram which illustrates an exemplary embodiment of the invention, for obtaining the relative time values shown in the timing diagram of FIG. 2. The 10 μs delay for the control power associated with the gate pulse suppression circuits 89 may be obtained by an RC circuit 120 having a resistor 122 and a capacitor 124 serially connected from source 100 to ground. The junction 126 between resistor 122 and capacitor 124 is connected to the control voltage input $V_{cc}$ of the gate pulse suppression circuits 89. Resistor 122 may have a value of 5.1 ohms and capacitor 124 may have a value of 2 μF for example. The different delay times for the control power associated with the bank selector circuit 64 may be obtained by a parallel RC circuit 130 connected between terminals 131 and 133, and a diode 132. The parallel RC circuit 130 includes a resistor 134 in one leg of the parallel circuit, and a capacitor 136 in the other leg. The anode of diode 132 is connected to the power supply 100, and its cathode is connected to terminal 131 of the parallel circuit 130. Terminal 133 of the parallel circuit 130 is connected to the control voltage input $V_{cc}$ of the bank selector circuit 64. Resistor 136 may have a value of 500 ohms and capacitor 134 may have a value of 0.1 μF for example. When control power is applied to the parallel RC circuit, capacitor 136 is rapidly charged through the relatively low resistance of the diode 132. When feeder power is interrupted or lost, capacitor 136 discharges through the relatively large resistor 134, providing a longer application of control power to the bank selector circuit 64 than provided by the RC circuit 120 for the gate pulse suppression circuits 189.

The invention was tried in an elevator installation where it was required as part of a periodic test routine to switch from a main feeder to an auxiliary feeder while the elevator cars were operating. This routine test normally resulted in fuse blowing of one or more SSMD. The SSMD of three of seven elevator cars were modified according to the teachings of the invention, and AC feeders were switched while the seven cars were running up without load i.e., overhauling. Three out of the four cars without the modification of the invention blew one or more fuses, while none of the invention modified cars blew fuses.

We claim as our invention:

1. In a traction elevator system having an elevator car, a dual converter bank, solid state motor drive for driving said elevator car, first means for selecting the operative converter bank at any instant, and second means for providing gate firing pulses for the selected converter bank, the improvement comprising:

third means for providing electrical control power for said first and second means, and fourth means for controlling the relative times the first and second means are energized and deenergized by said control power, such that said first means is energized before said second means when said control power is available, and said first means is deenergized after said second means is deenergized, when said control power is lost.

2. In the traction elevator system of claim 1, wherein the fourth means includes first and second RC circuits associated with said first and second means, respectively, and further including non-linear means connected to charge and discharge a capacitor associated with the first RC circuit at first and second different rates which are respectively faster and slower than the charging and discharging rates of a capacitor associated with the second RC circuit.

3. In the traction elevator system of claim 2, wherein the first and second RC circuits are parallel and series RC circuits, respectively.

* * * * *